US012172826B2

(12) United States Patent
Wicks et al.

(10) Patent No.: US 12,172,826 B2
(45) Date of Patent: Dec. 24, 2024

(54) BEVERAGE PREPARATION CAPSULES

(71) Applicant: Luigi Lavazza S.p.A., Turin (IT)

(72) Inventors: David Wicks, Basingstoke (GB); Paul Fletcher, Surrey (GB)

(73) Assignee: Luigi Lavazza S.p.A., Turin (IT)

( * ) Notice: Subject to any disclaimer, the term of this patent is extended or adjusted under 35 U.S.C. 154(b) by 544 days.

(21) Appl. No.: 16/608,325

(22) PCT Filed: Apr. 27, 2018

(86) PCT No.: PCT/US2018/029898
§ 371 (c)(1),
(2) Date: Oct. 25, 2019

(87) PCT Pub. No.: WO2018/201015
PCT Pub. Date: Nov. 1, 2018

(65) Prior Publication Data

US 2020/0165062 A1 May 28, 2020

(30) Foreign Application Priority Data

Apr. 28, 2017 (GB) ..... 1706836

(51) Int. Cl.
*B65D 85/804* (2006.01)

(52) U.S. Cl.
CPC ..... *B65D 85/8061* (2020.05)

(58) Field of Classification Search
CPC ..... B65D 85/8043
See application file for complete search history.

(56) References Cited

U.S. PATENT DOCUMENTS 4,602,910 A * 7/1986 Larkin ..... A61J 1/2093 604/410
4,853,234 A * 8/1989 Bentley ..... B65D 85/8043 426/77
6,319,243 B1 * 11/2001 Becker ..... A61P 7/08 206/568
2004/0078023 A1 * 4/2004 Gollier ..... A61J 1/2093 604/410
2007/0259139 A1 * 11/2007 Furneaux ..... B32B 27/10 428/34.3

(Continued)

FOREIGN PATENT DOCUMENTS

CN 101939233 A 1/2011
CN 104853996 A 8/2015

(Continued)

OTHER PUBLICATIONS

International Search Report for PCT/US2018/029898 mailed Jul. 27, 2018.

(Continued)

*Primary Examiner* — Erik Kashnikow
*Assistant Examiner* — Chaim A Smith
(74) *Attorney, Agent, or Firm* — The Belles Group, P.C.

(57) ABSTRACT

The present invention relates to beverage preparation capsule containing a beverage preparation ingredient, and methods for the preparation of beverages. In one aspect, these include beverage preparation capsules for use in beverage preparation apparatus comprising a clamp assembly suitable for preparing espresso-type beverages.

20 Claims, 8 Drawing Sheets

(56) References Cited

U.S. PATENT DOCUMENTS

| | | | | |
|---|---|---|---|---|
| 2008/0240628 | A1* | 10/2008 | VanLoocke | B65D 75/5855 383/210 |
| 2010/0163440 | A1* | 7/2010 | Tsang | B65D 81/3266 206/219 |
| 2014/0287104 | A1* | 9/2014 | Austin | A47J 31/369 426/115 |
| 2016/0096681 | A1* | 4/2016 | Wicks | B65D 85/8043 426/115 |

FOREIGN PATENT DOCUMENTS

| | | | |
|---|---|---|---|
| CN | 104995108 | A | 10/2015 |
| EP | 0272922 | A2 | 6/1988 |
| JP | 2013/233315 | A | 11/2013 |
| JP | 2014/516749 | A | 7/2014 |
| WO | WO 99/05044 | A1 | 2/1999 |
| WO | WO 2005-030482 | A1 | 4/2005 |
| WO | WO 2012/175985 | A1 | 12/2012 |
| WO | WO 2014-181129 | A1 | 11/2014 |
| WO | WO 2015-001340 | A1 | 1/2015 |

OTHER PUBLICATIONS

Chinese Search Report for related Application No. 2018800278687 issued Jun. 2, 2021.

* cited by examiner

BEVERAGE PREPARATION CAPSULES

TECHNICAL FIELD

The present invention relates to beverage preparation capsules and methods for the preparation of beverages. In particular, these include beverage preparation capsules for use in beverage preparation apparatus comprising a clamp assembly suitable for preparing espresso-type beverages.

BACKGROUND ART

A number of beverage-making systems are known. Typically, a single serving of beverage is made by inserting a capsule containing a particulate beverage-making ingredient, such as ground coffee, into a beverage-making station of a beverage-making apparatus. The apparatus then injects water into the capsule, to allow the beverage-making ingredient to dissolve or infuse into the water and form the beverage. The beverage then flows out of the capsule through a suitable outlet, which may be an opening or perforation in the capsule, or it may involve an outlet tube that pierces an outlet region of the capsule. The capsule may also incorporate a filter to prevent passage of solid components such as coffee grounds out of the capsule. For example, beverage-making systems of this general type are described in WO9401344A1, EP0512468A1 and EP0468079A1 (all Nestle), U.S. Pat. No. 5,840,189 and WO0160220A1 (Keurig), EP0272922A2 (Kenco), WO2007093355A1 (Samar Technologies), US20110142996A1 (Kruger), EP0710462A1 (Illycaffe), EP0821906A1, US20110000376A1 and US20110027425A1 (Sara Lee). Moreover, GB2121762A, GB2122881A, EP0179641A2, EP0247841A2, WO9905044A1, WO0219875A1 and WO2012175985A1 describe capsule-based beverage preparation systems of the type that are now widely used and marketed by Mars Drinks under the registered trade mark FLAVIA®.

For the preparation of certain premium beverages, such as espresso coffee, water should be passed through the coffee bed at a pressure of greater than 5 bar (500 kPa), up to about 20 bar (2000 kPa). The capsule is therefore inserted into a rigid, metal brewing chamber that is normally shaped to fit tightly around the capsule. The rigid, metal brewing chamber restrains and supports the capsule so that hot water can be injected into the interior of the capsule at a pressure of 5-15 bar (500-1500 kPa) without bursting the capsule.

In this context, it is also known to brew individual portions of espresso coffee from individual capsules having a frustoconical or oblate spheroid shape formed from air- and moisture-impermeable material, containing a portion of tightly compacted ground coffee. The capsule is inserted into a rigid, metal brewing chamber that is normally shaped to fit tightly around the capsule. The brewing chamber has a filter element in its base, a means to pierce the underside of the capsule, and a means to inject hot water at a pressure of 500-1500 kPa (5-15 bar) into the interior of the capsule to brew espresso coffee. Espresso coffee brewing capsules and systems of this type are described, for example, in WO9317932A1 and WO9402059A1.

Beverage-making capsules of the above types have found widespread use. However, they suffer from several drawbacks. For example, many existing beverage brewing capsules are unsuitable to contain combinations of multiple beverage preparation ingredients in the same capsule, where the ingredients are incompatible with one another. This is because certain ingredients can undergo adverse reactions when the ingredients are mixed together in the same capsule during storage, which leads to spoilage of the ingredients or a reduction in quality of the beverage.

Moreover, many existing espresso brewing capsules are adapted for and limited to use with specific conventional espresso machines that have a rigid brewing cavity correctly dimensioned to receive a bed of coffee of specific dimensions and to apply the required pressure to such a bed of coffee. This presents several problems, because there is only limited scope to vary the amount of coffee in the capsule, or to vary the degree of compaction of the coffee bed during brewing, or to use non-standardised capsules.

Attempts have been made to overcome the above problems, but with only limited success and many problems remain. For example, EP0521186A1 describes a capsule containing a compressed beverage brewing ingredient, such as ground coffee, for use in espresso-type machines. The capsule is deformable to assume the shape of the cavity of whichever espresso machine it is used in. This removes the need for a special adapter to adapt existing espresso machines to the exact shape and configuration of the capsule. Unfortunately, it also means that the coffee in the capsule may be insufficiently compacted for optimal espresso coffee brewing and there is no ability to prevent adverse reactions between multiple beverage ingredients. The deformability of the capsule to assume the shape of the cavity also places extra stress on the capsule, which increases the risk that the capsule could burst, especially if placed in too large a cavity and subjected to too high a pressure. The problem of cross-contamination by successive brews also exists for this configuration, which is caused by beverage exiting the capsule through the base part of the brewing chamber, thereby contaminating the brewing chamber.

EP0821906A1 describes methods of brewing beverages in which a vacuum pack containing a beverage brewing ingredient is placed in a clamp, hot water is injected into the vacuum pack through a hollow needle, and the brewed beverage is allowed to escape through a closing seam in the vacuum pack. The pack includes a movable plate opposite the closing seam of the vacuum pack that is used to compress the vacuum pack in the clamp before brewing. The plates making up the brewing cavity are rigid, flat plates. However, these plates cannot apply high pressure to squeeze the vacuum pack without risk of bursting the pack and there is no ability to prevent adverse reactions between multiple beverage ingredients.

WO0219875A1 describes an apparatus for the brewing of a beverage by transmission of an aqueous fluid through a capsule containing a beverage brewing ingredient, said apparatus comprising: one or more injectors to inject the aqueous fluid into the capsule during said brewing; and a clamp for the capsule, said clamp comprising one or more members that are movable to open and close the clamp, said members having inner surfaces which in a closed position of the clamp define a cavity adapted to substantially enclose and support the capsule during said brewing and further adapted to define a beverage exit pathway in a lower part of the cavity, and wherein the inner surface of at least one clamp member comprises at least one deformable region mounted on a support that is movable while the clamp is in said closed position, whereby the shape of said cavity or said exit pathway can be changed while the clamp is in said closed position to provide a desired brewing configuration of the capsule. The capsule is suitably a capsule of the FLAVIA® type, optionally with modifications.

WO02015001340A1 describes a beverage preparation capsule containing a beverage preparation ingredient and an additional functional ingredient, wherein at least a portion of an inside surface of the capsule is coated with a water-dispersible coating containing the functional ingredient. The functional ingredient can be a flavonoid, such as a cocoa polyphenol extract. The coating containing the functional ingredient can help to avoid adverse reactions between the functional ingredient and the beverage preparation ingredient. However, in order to do so, the functional ingredient needs to be embedded in the water-dispersible coating, which limits the amount of functional ingredient that can be included in the capsule to relatively small amounts (typically only about 0.5 mg to about 500 mg) that would not be suitable for providing a major component of the beverage.

Accordingly, the aforementioned capsules do not provide a convenient and reliable means to prepare beverages derived from multiple beverage preparation ingredients. A need therefore exists for capsules that can contain multiple beverage preparation ingredients, whilst avoiding or minimising the risk of adverse reactions between ingredients during storage before use. Suitably, although not exclusively, these capsules could be for use in equipment of the FLAVIA® type.

Moreover, when used in a clamp assembly, the existing capsules of the prior art rely on a perfect alignment of the capsule within the clamp, which can be difficult to achieve all of the time. If the capsule is not perfectly aligned within the clamp, the clamp members may clamp over a portion of the capsule that holds the beverage preparation ingredient. This can cause several problems. Firstly, portions of the beverage preparation ingredient may become trapped between the clamp members, which reduces the amount of beverage preparation ingredient that can be brewed. This can result in wasted beverage preparation ingredient and a beverage having reduced concentration of dissolved or infused material, leading to inconsistent vending performance and poor beverage taste. Secondly, where beverage preparation ingredient is trapped between the clamp members, this can reduce the quality of the seal between the two clamp members, which can cause the brewed beverage to bleed out of the clamping assembly, potentially causing the flexible film material of the capsule to rupture under high pressure if it is not properly supported by the clamp. Thirdly, the available volume of the brewing chamber may be reduced, because a portion of the brewing chamber is now trapped between the clamp members. This can also lead to inconsistent vending performance and can place additional strain on the capsule. In order to avoid these problems, conventional thinking has been to carefully control the manufacture of beverage preparation capsules so that the capsule can be reliably aligned with the clamp members. However, this leads to increased manufacturing costs and is not always successful.

A need therefore remains for improved capsules and methods for preparing beverages from capsules, especially capsules for use with high pressures for producing espresso and espresso-type beverages. Suitably, although not exclusively, these capsules could be for use in equipment of the FLAVIA® type.

STATEMENT OF INVENTION

Accordingly, the present invention provides a beverage preparation capsule containing a beverage preparation ingredient, the beverage preparation capsule comprising front and back sheets of substantially air- and liquid-impermeable flexible film material bonded together in face-to-face relationship along a top region, first and second side regions, and a bottom region to define a chamber containing the beverage preparation ingredient, wherein said bottom region comprises an outlet channel for escape of beverage from the chamber containing the beverage preparation ingredient, wherein at least a region of said outlet channel is filled by a filtration material for filtering said beverage escaping from the chamber, and wherein at least one bond between said front and back sheets of flexible film material in at least one of said top region or first or second side region comprises a peelable seal.

A peelable seal is a bond between two materials (such as flexible film material) that can be peeled apart when a force and/or heat is applied thereto, without the material itself breaking or melting. In other words, the two materials can be separated from each other by peeling the seal, but the separated materials each remain intact. In contrast, a permanent seal is a bond between two materials (such as flexible film material) that cannot be peeled apart without breaking or melting the materials themselves. This is because the force and/or heat that would be required to overcome the seal is greater than the force and/or heat that the materials themselves can withstand, such that the materials break or melt before the seal would be able to peel apart. Thus, for a peelable seal between two flexible film materials, the integrity of the seal (in the broad sense of mechanical, thermal and/or chemical integrity) is lower than the integrity of the flexible film material. While, for a permanent seal, the integrity of the seal (in the broad sense of mechanical, thermal and/or chemical integrity) is greater than or equal to the integrity of the flexible film material.

In this way, the front and back sheets of flexible film material of the invention can peel apart in at least one of said bonded top region and first and second side regions when liquid is injected into the capsule during use, which allows the brewing chamber to expand to fill the available space provided by the clamp. Since the integrity of the peelable seal is less than the integrity of the flexible film material, the failure mode of the bonded regions around the beverage ingredient is to peel apart in a controlled fashion without the flexible film material of the capsule itself bursting and the beverage leaking into the clamp assembly. In this context, it should be noted that reference to the brewing chamber "expanding" does not mean that the flexible film material of the capsule substantially stretches or deforms elastically or plastically. Instead, the brewing chamber expands because at least some of the bonded regions that define the limits of the brewing chamber peel open. As a result, the present invention may provide a variety of advantages.

Firstly, since the brewing chamber will expand in use to fill the available space of the clamp cavity, the shape and size of the brewing chamber before use does not need to precisely match the shape and size of the clamp cavity. As such, the edges of capsule do not need to be perfectly aligned with the clamp, which reduces the requirement for a dimensionally accurate weld and avoids problems associated with misalignment of the nozzle and seal during manufacture. It also allows the same capsule to be used in a variety of different shaped clamping apparatus, because the capsule brewing chamber will expand to fill whatever space is available. However, during use, after the brewing chamber of the capsule has expanded to fill the clamp cavity, the inners walls of the clamp members in a closed position can still substantially enclose and support the beverage capsule and allow the use of high pressures to brew the beverage without bursting the capsule. In addition, the capsule also prevents the clamp from becoming cross-contaminated, meaning that the same clamping apparatus can be used multiple times with different single use capsules.

Secondly, the bonded regions of the top, first and/or second sides help to keep the beverage preparation ingredient away from the regions of the capsule to be clamped, so that the beverage preparation ingredient is not trapped between the clamping members. This allows the seal made by the clamping members to be more effective, meaning that higher pressure brewing may be used. This also reduces any strain placed upon the flexible film material of the capsule by ineffective clamping, thereby reducing the risk that the capsule may burst open and leak beverage into the clamp apparatus. Where permanent welds (where the integrity of the seal/weld is greater than or equal to the integrity of the flexible film material) are optionally additionally used, this also reduces strain placed on these permanent welds, which reduces the requirement for consistency of weld strength.

In another aspect of the invention, there is provided a method of making a beverage comprising inserting a beverage preparation capsule as previously described into a clamp assembly of a beverage preparation apparatus, the clamp assembly comprising two or more clamp members, at least one clamp member being movable to open and close the clamp assembly, wherein respective inner walls of said clamp members in a closed position define an enclosed space adapted to receive the beverage preparation capsule, the enclosed space having an inlet region for injection of water and an outlet region for escape of a beverage, the enclosed space of the clamp assembly being larger than the chamber of the capsule containing the beverage preparation ingredient before use; injecting an aqueous liquid into said capsule at a pressure greater than about 1 bar gauge to produce a beverage in said capsule, wherein the bond comprising a peelable seal between said front and back sheets of flexible film material in at least one of said top region or first or second side region peels apart upon injection of the aqueous liquid such that the chamber of the capsule containing the beverage preparation ingredient expands to fill the enclosed space of the clamp assembly; and allowing said beverage to escape through the outlet region. Typically, the aqueous liquid may consist essentially of water at a temperature of about 80° C. to about 100° C., and the water is injected at a pressure of from about 5 to about 15 bar gauge.

The present invention also provides a beverage preparation capsule containing a first and second beverage preparation ingredient, wherein said first beverage preparation ingredient is separated from said second beverage preparation ingredient by a peelable seal. The peelable seal is arranged such that in use when liquid is injected into the capsule for preparing a beverage, the peelable seal peels apart and allows the first and second beverage preparation ingredients to mix together. Suitably, the peelable seal defines a first compartment containing the first beverage preparation ingredient and a second compartment containing the second beverage preparation ingredient.

This arrangement is particularly advantageous where the first and second beverage preparation ingredients are incompatible with each other and may cause adverse reactions when mixed over a prolonged period of time during storage. In this way, the beverage preparation ingredients are kept separate to minimise or avoid adverse reactions during storage. In use, when liquid is injected into the capsule for preparing a beverage, the peelable seal can peel apart and allow the first and second beverage preparation ingredients to mix together with the liquid to form a multi-component beverage with improved freshness and taste.

Thus, in another aspect of the invention, there is provided a method of making a multi-component beverage comprising inserting a beverage preparation capsule containing a first and second beverage preparation ingredient as previously described into a clamp assembly of a beverage preparation apparatus, the clamp assembly comprising two or more clamp members, at least one clamp member being movable to open and close the clamp assembly, wherein respective inner walls of said clamp members in a closed position define an enclosed space adapted to receive the beverage preparation capsule, the enclosed space having an inlet region for injection of water and an outlet region for escape of a beverage; injecting an aqueous liquid into said capsule at a pressure greater than about 1 bar gauge to produce a beverage in said capsule, wherein the peelable seal peels apart upon injection of the aqueous liquid to allow the first and second beverage preparation ingredients of the capsule to mix: and allowing said beverage to escape through the outlet region.

DETAILED DESCRIPTION OF THE INVENTION

The term "capsule" as used herein refers to a container for carrying a beverage preparation material. Suitably, the capsule may comprise front and back sheets of substantially air- and liquid-impermeable flexible film or sheet material bonded together in face-to-face relation to form a flexible film sachet. The front and back sheets may be similar, identical or different.

Typically, the capsule comprises at least one plastics sheet (e.g. thermoformed or injection molded sheet). The sheet will usually be a laminate comprising two or more of the following layers: a thermoplastic sealant layer for bonding the sheet to other members of the package; a substantially gas-impermeable barrier layer, which suitably is a metal film such as aluminium film; adhesion layers to improve adhesion between other layers of the laminate; structural layers, for example to provide puncture resistance; and/or a printing substrate layer. The structural layers could be made of polyolefins, polyester, nylons, or other polymers as is well known in the art. Suitable materials and methods of manufacture are described, for example, in the already-cited patent specifications relating to the FLAVIA capsule system, for example GB2121762A, GB2122881A, EP0179641A2, EP0247841A2 and WO9905044A1.

The front and back sheets are bonded together along a top region, first and second side regions, and a bottom region to define a chamber in which the beverage preparation ingredient is stored, and in which the beverage is prepared by infusion or dissolution of the beverage preparation ingredient. At least one of said bonded top region or first or second side regions comprises a peelable seal. Suitably, the first and second side regions each comprise a peelable seal. It has been found that this arrangement provides a good ability for the brewing chamber to expand in use to fill the available space of the clamp cavity. Optionally, substantially all of the bonded top region and first and second side regions comprise a peelable seal, such that the chamber containing the beverage preparation ingredient is substantially encircled and defined by a peelable seal.

The ingredient chamber is preferably substantially filled by the ingredient, for example at least about 50% of the volume of the chamber is filled by the ingredient. Typically, the amount of ingredient contained in the capsules is sufficient for the preparation of one portion of beverage, i.e. in the case of espresso coffee from about 10 ml to about 250 ml, suitably from about 25 ml to about 125 ml of beverage. For example, the capsule may contain from about 2 g to about 25 g of ground coffee or from about 1 g to about 9 g of leaf tea.

In a particularly preferred embodiment, there is provided a beverage preparation capsule containing a first and second beverage preparation ingredient, wherein said first beverage preparation ingredient is separated from said second beverage preparation ingredient by a peelable seal. In this way, the peelable seal allows a single capsule to contain multiple beverage preparation ingredients, which are kept separate until liquid is introduced into the capsule and the peelable seal peels apart. Suitably, the peelable seal may define separate compartments for each beverage preparation ingredient, such as a first compartment containing the first beverage preparation ingredient and a second compartment containing the second beverage preparation ingredient.

Conveniently, although not limited thereto, the capsule containing a first and second beverage preparation ingredient may be formed from front and back sheets of substantially air- and liquid-impermeable flexible film material bonded together in face-to-face relationship to define a chamber containing the first and second beverage preparation ingredients and an outlet channel for escape of beverage from the chamber, wherein at least a region of said outlet channel is filled by a filtration material for filtering said beverage escaping from the chamber, and wherein said first and second beverage preparation ingredients are separated by a peelable seal between said front and back sheets of flexible film material.

Suitably, for a capsule containing multiple compartments of beverage preparation ingredient, the compartments are both located upstream of a filter material in the capsule, and this is the preferred arrangement. However, it is also envisaged that one or more compartments of beverage preparation material could be located downstream of the filter material, if the beverage material in question did not require filtering for preparation of a beverage, such as milk. For example, a capsule could contain a first beverage preparation ingredient compartment defined by peelable seals containing ground coffee located upstream of the filter material, and a second beverage preparation ingredient compartment defined by peelable seals containing milk, powdered milk or creamer located downstream of the filter material.

Suitably, at least one, preferably more than one, of said peelable seals may be inset from the peripheral edge of the capsule. The peelable seal may extend 10 mm to 30 mm, or 15 mm to 25 mm, in from the peripheral edge of the capsule, meaning that it is significantly wider than conventional bonded regions around of the peripheral edge of capsules of the prior art, which assists in locating clamping members over the peelable seal of the present invention when the capsule is located in a damping assembly during use, without inadvertently trapping beverage preparation ingredient between the clamping members. For example, for a capsule comprising front and back sheets of approximately 70 mm by 100 mm in dimensions, a peelable seal between said front and back sheets may extend from about 10 mm to about 30 mm in from the peripheral edge of the capsule, such from about 15 mm to about 25 mm in from the peripheral edge of the capsule.

Suitably, the chamber containing the beverage preparation ingredient is substantially encircled by the peelable seal. This also helps to keep the beverage preparation ingredient away from the peripheral edges of the capsule so that the risk of the clamp damping over the beverage preparation ingredient is minimised. It is particularly useful that the first and second side regions are also inset from the side peripheral edges of the capsule. Alternatively or additionally, the top bonded region may be inset from the top peripheral edge of the capsule, which may help to keep the beverage preparation ingredient away from the top seal, or if a nozzle is present in the top seal, to keep the beverage preparation ingredient away from the nozzle.

The bottom region of the capsule comprises an outlet channel for escape of beverage from the chamber containing the beverage preparation ingredient. For example, the outlet channel may have an upstream end in fluid communication with the chamber containing the beverage preparation ingredient, or the outlet channel may be sealed with a peelable seal that peels apart during use on injection of liquid into the capsule to form a fluid communication with the chamber containing the beverage preparation ingredient. At least a region of said outlet channel is filled by a filtration material for filtering said beverage escaping from chamber.

The term "outlet channel" refers to a channel extending from the beverage ingredient chamber, through which the beverage escapes from the chamber during beverage preparation. The outlet channel is substantially free of beverage ingredient. The outlet channel has a length in the direction of flow of the beverage, and a cross-section perpendicular to that flow. The length of the outlet channel is suitably from about 1 mm to about 20 mm, for example about 5 mm to about 10 mm. The uncompressed mean cross-section area of the outlet channel is substantially less than that of the beverage ingredient chamber, for example the mean uncompressed cross-sectional area of the outlet channel is suitably no more than about 10% of the mean uncompressed cross-sectional area of the beverage ingredient chamber. Furthermore, as will be explained further below, the outlet channel may be compressed (pinched) during beverage preparation to further reduce its cross-section. In embodiments, the mean width of the outlet channel is suitably from about 5 mm to about 30 mm, for example about 10 mm to about 20 mm, and the mean uncompressed depth of the outlet channel is less than about 4 mm, for example from about 0.4 mm to about 2 mm.

For example, the brewing chamber may be defined by bonding the sheets together in face-to-face relation around a margin using either peelable or permanent seals or a selection of both, and the outlet may be provided by leaving an unbonded region or a peelable seal between the sheets in one of the margins. Suitably, the outlet is in the form of an elongate opening in a bottom edge of the chamber, for example a slit. The outlet suitably has a length of from about 5 mm to about 50 mm, more suitably from about 10 mm to about 30 mm. It will be appreciated that more than one such outlet could be provided.

The outlet channel is at least partially filled with the filtration material. That is to say, at least a portion of the length of the outlet channel is substantially completely filled with the filtration material, whereby the beverage escaping from the ingredient chamber must pass through filtration material when transiting the outlet channel. Suitably, the filtration material extends along the whole width and length of the outlet channel, whereby the outlet channel is completely filled by the filtration material in use.

A bottom bonded region comprising a peelable seal may be located between the chamber containing the beverage preparation ingredient and the outlet channel, which is in order to keep the beverage preparation ingredient away from the filter material located in the outlet channel. This can be especially useful where the beverage ingredient and filter material may adversely react with each other over a prolonged period of storage. In use, the bottom bonded region comprising a peelable seal peels apart on injection of liquid into the capsule to form a fluid communication between the chamber containing the beverage preparation ingredient and the outlet channel, such that the beverage can escape from the outlet channel.

In embodiments, the filtration material is in the form of a plug of filtration material located in said outlet channel, and optionally bonded to the side walls in the outlet channel. However, the filtration material is not normally bonded to the wall of the capsule inside the outlet channel.

The filtration material may project from the outlet channel into the chamber containing the beverage preparation ingredient. Alternatively, the filtration material may project from the outlet channel into a bonded region comprising a peelable seal located downstream from the chamber containing the beverage preparation ingredient. This can be desirable to provide a more efficient and effective filtering action, since the surface area of the filter can be greater than the cross sectional area of the outlet channel. For example, the filtration material may project from about 5 mm to about 100 mm into the capsule body, suitably from about 10 mm to about 50 mm into the capsule body. In certain embodiments the filtration material may also extend downstream of the outlet channel. These embodiments reduce the tendency of beverage solids to block the small cross-section of the outlet, and therefore they provide more consistent flow.

The filtration material may be in the form of a resilient filtration pad located in the outlet. Suitable materials for forming the filter are water-insoluble but suitably hydrophilic, food-acceptable materials. For example, they may comprise a liquid-permeable foam material such as a polyurethane foam or an open-cell polyolefin foam. More suitably, the filter comprises or consists essentially of fibers of substantially water-insoluble material, for example a woven or nonwoven fabric. The fibers making up the filter may be any suitable food-acceptable fibers such as cellulose fibers, polyolefin fibers or nylon fibers.

The filter may be built up from multiple layers of a conventional beverage filter sheet material, for example the type of material used to form tea or coffee bags. The filter may comprise at least 2, for example 3 to 6, stacked layers of the filter material. In these embodiments, for example, the filter could be made by rolling or folding a single sheet of filter material into multiple layers.

The filtration material may be in the form of a plug of filtration material located in said outlet channel, or in the form of two or more stacked layers of filtration sheet. This may involve two or more stacked layers formed from a single filter sheet having first and second edges bonded to opposite front and back sheets of said capsule, respectively, said sheet being V-folded or W-folded between said side walls to form said stacked layers in said outlet channel.

The filtration material may be formed from a single sheet of beverage filter sheet material having opposed edges bonded to the inside of the beverage ingredient chamber and extending into an outlet or conditioning chamber, with a V-fold located in or below the outlet channel, whereby the filtration plug in the outlet channel is formed by a double thickness of the filter sheet material in the outlet channel. Suitably, the single sheet is bonded across substantially the entire width of the beverage ingredient chamber.

Conveniently, the top and bottom peripheral edges of the capsule may comprise a bond between the front and back sheets comprising a permanent seal or weld (in addition to and separate from the aforementioned bonded regions comprising a peelable seal). Such permanent seals can be formed by heat or ultrasonic bonding, for example by pressing sheets of flexible film material together at a temperature above the melting temperature of the flexible film material for at least about 0.5 second at a pressure of at least about 20 psi. This can be useful to secure an inlet or nozzle in the top seal, or a filter material or outlet in the bottom seal, and to provide improved structural integrity to the capsule as a whole.

At least some or substantially all of the peripheral edges of the first and second sheets may be bonded together with a permanent seal, with the exception of the outlet channel. In this case, the peelable seals as discussed previously would be located in areas within the periphery set by the permanent seals. For example, the permanent seal could be heated-sealed polypropylene. This also provides improved structural integrity to the capsule as a whole. It also has the advantage that the capsule can alternatively be used in a low pressure beverage preparation apparatus, which does not have a clamping apparatus. In this case, a strong permanent weld around the periphery of the capsule would be able to prevent the capsule from bursting upon the introduction of liquid into the capsule.

The capsule is suitably a sealed capsule formed from materials that are substantially impermeable to oxygen and moisture in order to preserve the freshness of the beverage ingredient. However, it should be noted that the integrity of the seal may only be a peelable seal. The term "sealed" should not be understood as requiring permanent seals, such as welds, although these may be optionally additionally present.

Preferably, the capsule is substantially shelf stable. That is to say, it may be stored at ambient temperature and atmospheric conditions for a period of at least about 3 months, preferably at least about one year, without significant deterioration of the contents.

The capsule may comprise or consist essentially of a compostable material. The term "compostable" signifies that the material is substantially broken down within a few months, suitably within a few weeks, when it is composted. Typically, the capsule is at least about 90% composted within six months, as determined by the method of ISO14855, as in EN13432. Thermoplastic compostable polymers that could be used for the capsule include polymers and copolymers of lactic acid and glycolic acid, polyhydroxybutyrates, polyvinyl alcohols (PVOH), ethylene vinyl alcohols (EVOH), starch derivatives, cellulose and cellulose derivatives, and mixtures thereof.

The capsule may comprise a bonded region comprising a permanent seal between said front and back sheets extending laterally across said capsule between opposed side edges below the top edge, and having a gap defining the outlet channel. Optionally, the gap defining the outlet channel could be sealed with a peelable seal. This is useful where the capsule provides a conditioning chamber downstream of the outlet channel, which could, for example, be a bifurcated conditioning chamber.

Thus, the capsule may further comprise an outlet chamber in fluid communication with a downstream end of said outlet channel (or in fluid communication during use) said outlet chamber having one or more outlets for escape of beverage from the capsule. For example, outlet chamber may be a conditioning chamber having a bifurcated shape and two outlets located on opposite sides of the capsule. The outlets may be sealed by a heat-releasable adhesive prior to use of the capsule.

The downstream chamber is suitably considerably smaller than the beverage ingredient chamber, for example no more than about 25% of the volume of the beverage ingredient chamber. The outlet channel and the downstream chamber (where present) are suitably located at an end of the capsule opposite to the locus of liquid injection, e.g. an injection nozzle. The capsule may be suitably substantially axially symmetric (i.e. has two-fold rotation/reflection symmetry about a longitudinal axis), and suitably the injection nozzle (where present), the outlet channel, and the downstream chamber (where present) lie on the longitudinal axis.

The downstream chamber may function as a conditioning chamber for the beverage exiting the outlet, that is to say a chamber in which bubbles within the liquid can separate from the liquid to form a "crema" on espresso coffee. Alternatively or additionally the downstream chamber may comprise one or more conduits for directing the beverage to one or more beverage outlets. For example, the downstream chamber may be bifurcated to direct the beverage to two outlets located adjacent to opposite edges of the capsule. In other embodiments, the downstream chamber may be funnel-shaped to direct the beverage to a single outlet located centrally. In these embodiments, the beverage outlet from the downstream chamber (or from the outlet channel where no downstream chamber is present) is suitably sealed with a suitable freshness barrier before use to preserve the freshness of the capsule contents.

The term "freshness barrier" refers to a barrier that is substantially impermeable to air or moisture so as to preserve the freshness of the beverage brewing ingredient by preventing ingress of air or moisture through the liquid guide before brewing commences. The freshness barrier may be released by an external mechanical force or thermal field applied during brewing. The freshness barrier is preferably releasable by the action of pressure and/or hot water from inside the capsule during brewing. For example, the freshness barrier may comprise a layer of a sealant that is released by the action of heat and/or moisture, such as an adhesive as described in EP0179641A2 or WO9905036A1.

The capsule suitably further comprises a nozzle through which liquid can be injected into the chamber containing the beverage preparation ingredient. The nozzle is suitably a thermoplastic nozzle having a tubular bore for receiving a liquid injector tube from a beverage preparation machine. The bore may be cylindrical, or it may have a non-circular cross-section. The nozzle may have a single outlet inside the chamber, or it may have a plurality of outlets inside the chamber, for example an outlet manifold for distributing the beverage making liquid within the enclosure. The nozzle outlet or outlets may be located at an edge of the capsule, or they may be located more centrally within the enclosure. Suitable nozzles are described in EP0179641A2 and WO9905036A1. The inlet end of the nozzle may comprise an annular seat (recess) around the bore for receiving an O-ring on the injection tube to form a pressure-tight seal between the injection tube and the nozzle.

Suitably, the nozzle is sealed by a frangible barrier to prevent escape of the beverage preparation ingredient prior to preparation of the beverage. The frangible barrier may comprise, or consist essentially of, a thin sheet of film material that can be pierced by a liquid injector tube on a beverage making machine. In other embodiments in which the nozzle is molded from thermoplastics, the frangible barrier may be a thermoplastic barrier molded in one piece with the nozzle, and having at least a peripheral region of weakness to enable the barrier to be pierced by a liquid injector tube on a beverage making machine.

The basis of operation of the capsules according to the invention is that the beverage is prepared by injection of water into the beverage ingredient chamber where the beverage is formed, such that the injection of water causes the peelable seal to peel apart. The beverage may then be filtered as it escapes from the ingredient chamber through the outlet channel. The filtration material may fill (plug) at least a portion of the length of the outlet so that the beverage cannot escape from the body without passing through the filter. The filtration material may be suitably sufficiently compressible, and preferably resilient, to enable control of the liquid escape cross-section by compressing the filtration material. The filtration material may generate a back pressure across the outlet channel, whereby high brewing pressures can be maintained inside the ingredient chamber (e.g. for brewing espresso coffee) without excessively fast escape of beverage. This back pressure can be regulated or fixed by applying a pinch to the outlet channel to compress the filtration material, thereby varying the liquid escape cross-section through the outlet channel. The back pressure may also assist in the controlled peeling apart of the bonded regions comprising a peelable seal, which assists in the expansion of the capsule's beverage preparation chamber to fill the available space of the clamping apparatus.

The capsules may be used with a clamp assembly comprising two generally concave clamp members that can be moved together to close the clamp. One or both of the clamp members may include a heater to heat the beverage ingredient inside the capsule before and/or during beverage preparation. The heater may, for example, comprise an electric heater element inside or on the surface of one or both of the clamp members. In other embodiments, one or both of the clamp members may be heated by circulation of hot water or steam through conduits inside the member. The heater suitably achieves a temperature of about 90-110° C. at the surface of the heated clamp member. The heating of the beverage ingredient is desirable in order to provide a constant, optimised extraction temperature, for example about 90° C. to 95° C. for espresso coffee. In the absence of external heating the thermal energy needed to heat up the beverage ingredient can cause an initial drop in the brewing temperature below optimum values, especially for drinks that require a low-volume of hot water, such as espresso coffee. The configuration of the clamp cavity may be fixed once the clamp elements have been brought into engagement to clamp the capsule. Or alternatively, the configuration of the clamp cavity may be varied during the beverage preparation cycle, for example as described in WO0219875A1, the entire content of which is incorporated herein by reference.

As explained further below, the capsules of the invention may be used in a brewing apparatus comprising a clamp cavity. However, contrary to the prior art, the capsule may not initially be in complete contact with the inner surfaces of the clamp cavity before use. For example, the unexpanded capsule is placed in the clamp cavity and the clamp closed around the capsule, pinching and sealing the peripheral bonded regions of the capsule, but not clamping over beverage ingredient which is maintained away from the periphery of the capsule by the bonded regions comprising a peelable seal.

During use, when liquid is injected into the beverage ingredient chamber of the capsule, the peelable seal peels apart to allow the brewing chamber to expand to fill the available space provided by the clamp and/or to allow multiple beverage preparation ingredients to mix. After the capsule may expand, the clamp cavity may then support the beverage brewing capsule enclosed within the cavity, thereby enabling high hydrostatic pressures to be developed inside the capsule without bursting the capsule.

Seal Strength

Seal strength (peak load seal strength) is measured according to the ASTM F88/F88M-15 "Standard Test Method for Seal Strength of Flexible Barrier Materials" of ASTM International, West Conshohocken, Pa., 2015, www.astm.org.

Atypical set up includes an Instron 5940-series single column tabletop testing system configured with pneumatic side-action grips. The sealed film is cooled to room temperature, and each tail of the specimen is secured in opposing grips. The seal remains unsupported while the test is being conducted and the seal strength is determined by measuring the peak load force require under linear tension per unit width of seal to peel the layers of the film apart at a contact speed of about 200 mm/min. If the film itself tears or snaps before the seal peels, no numerical data is obtainable and the sample considered as a permanent (non-peelable) seal.

In a preferred embodiment, the peelable seal has a peak load seal strength of less than about 20 N for a 15 mm width sample or less than about 30 N for a 25 mm width sample, such as between about 2 N to about 12 N for a 25 mm width sample, or between about 3.5 to about 8.5 N for a 25 mm width sample, or about 6 N for a 25 mm width sample. It has been found that these seal strengths are particularly suited for use with espresso-type beverages using a clamping assembly, such that the seal strength suitably peels back to the clamping members in a controlled fashion during use.

Peelable seals may be provided in various ways, including mechanically-releasable seals that fail by application of mechanical stress; heat-releasable seals that fail by elevated temperature; chemically-releasable seals that fail by reaction with a reagent; water-soluble seals that fail by dissolving upon contact with water, or a combination of any such means.

Heat-releasable seals may be formulated with a suitable thermoplastic resin or resins. A range of different resins can be employed. Potential starting points are polymer, copolymers & polymer blends based on the following systems: ethylene & its ionomers; acrylics/methacrylics; vinyl acetates; polyesters; polyamides; polyurethanes; polyvinylbutyrals.

For example, the peelable seal may be bonded with a heat-releasable adhesive, such as with a peelable polyethylene or polylactic acid seal.

Peelable seals may also be formed without adhesives, by using materials such as polyethylene pressed under certain conditions of temperature and pressure. An example of a suitable material is DuPont™ Surlyn® ionomer and polybutene, or a peelable PLA seal.

For example, a peelable seal in a polypropylene film can be created under conditions of about 120° C. and about 45 psi for about 1 sec.

A welded permanent seal may be created by pressing sheets of flexible film material together at a temperature above the melting temperature of the flexible film material, such as for at least about 0.5 second at a pressure of at least about 20 psi, preferably for at least about 1 second and at least about 30 psi. For example, a welded permanent seal in a polypropylene film can be created under conditions of about 200° C. and about 30 psi for about 1 second.

Ultimate Tensile Strength

Ultimate tensile strength (UTS), also known as tensile strength (TS) or ultimate strength, is the capacity of a material or structure to withstand loads tending to elongate. Ultimate tensile strength is measured by the maximum stress that a material can withstand while being stretched or pulled before breaking.

Ultimate Tensile Strength of the flexible film material of the present invention may be measured in accordance with ASTM D882-12 "Standard Test Method for Tensile Properties of Thin Plastic Sheeting" of ASTM International, West Conshohocken, Pa. 2015. www.astm.org.

For example, using a straight edge and a calibrated sample cutter (10 mm+\−0.5 mm) five strips (100 mm in length) of the flexible film material are cut along the machine direction. Each sample is tested using an Instron model 3111 materials test machine, using pneumatic action grips with rubber jaw faces. Temperature (23° C.) and relative humidity (50%) are controlled. The crosshead speed (rate of separation) is 25 $mm \cdot min^{-1}$. The strain rate is 50%. The maximum stress that the sample can withstand before breaking is determined as the ultimate tensile strength.

In a preferred embodiment, the ultimate tensile strength of the flexible film material may be greater than or equal to about 15 MPa, suitably greater than or equal to about 19 MPa. It has been found that this ultimate tensile strength is particularly well suited for use in brewing espresso-type beverages that require use of pressure. However, it should be noted that pressures higher than those suitable for an ultimate tensile strength greater than or equal to about 15 MPa are also possible provided that the capsule is used with a clamp assembly in which the inner walls of the clamp members in a closed position define a chamber adapted to substantially enclose and support the beverage capsule.

For example, the flexible film material may be polypropylene with an ultimate tensile strength of about 19 to about 80 MPa. Optionally, the flexible film material may also have a yield strength of about 12-43 MPa and a density of about 0.8-1.0 $g/cm^3$, such as about 0.91 $g/cm^3$.

DESCRIPTION OF THE DRAWINGS

Further details and specific embodiments of the present invention will now be described by way of example with reference to the accompanying drawings, in which:

Referring to FIG. 1, there can be seen a FLAVIA espresso-type beverage preparation capsule of the prior art disclosed in WO2012175985A1, which is a modification of a capsule described in EP0179641A2. The capsule 10 comprises two flexible laminate sheets. Each laminate sheet comprises an inner thermoplastic sealing film. The front and back sheets are bonded together along edge seams 11, top seam 12 and bottom seam 13. The bonding of the top and side edges is a permanent weld between the sheets, suitably formed by heat or ultrasonic bonding. At least a central region of the bottom seam 13 is bonded with a peelable adhesive that can be released by the action of heat and/or pressure of liquid inside the capsule, and/or assisted by heat applied from outside the capsule. A nozzle 14 is inserted into the top seam 12 of the capsule. The nozzle 14 has a central cylindrical bore sealed at the top by membrane 15.

Figure 1:
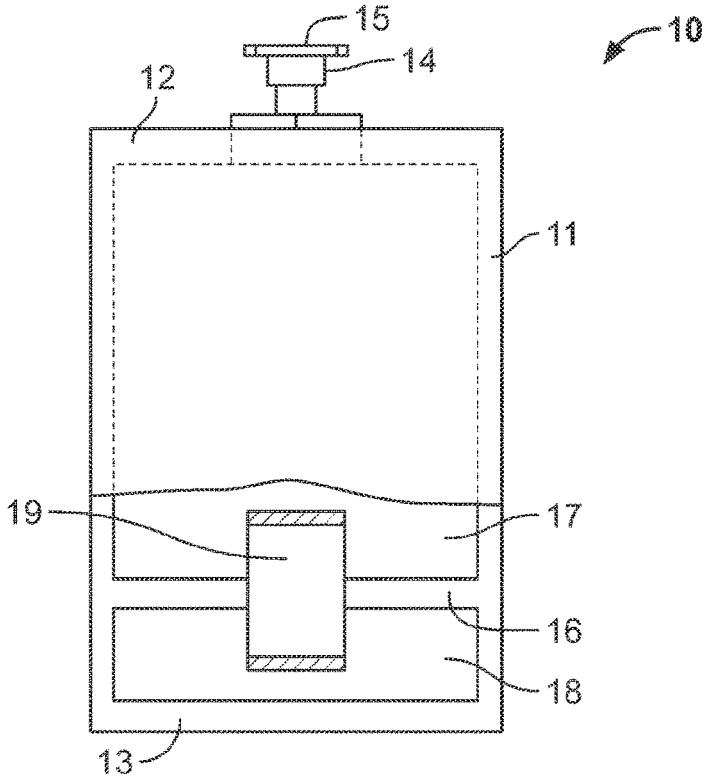
FIG. 1 (Prior Art )
FIG. 1 shows a FLAVIA® expresso-type beverage preparation capsule according to the prior art.

A further transverse permanently bonded seam 16 between the front and back sheets extends across the capsule intermediate the top and bottom transverse seals to divide the capsule into a beverage ingredient chamber 17 and a downstream beverage collection/conditioning chamber 18. The intermediate seam does not extend completely across the capsule. An unbonded gap is left in the intermediate seam to provide the outlet channel from the beverage preparation chamber. This gap is filled by a filtration element 19 formed by rolling up and flattening a sheet of filter sheet material. The filtration element 19 is bonded to the front and back sheets in the gap. The filtration material generates a back pressure across the outlet channel, so that high brewing pressures can be maintained inside the ingredient chamber (such as for brewing espresso coffee) without excessively fast escape of beverage. The filtration element projects into the beverage preparation chamber 17 so as to increase the area available for filtration and to prevent filter blocking in use. Substantially filling the ingredient chamber 17 of the capsule there is about 15 g of ground roasted coffee. The capsule provides an oxygen and moisture-impermeable enclosure for the coffee until the capsule is used.

In use, the capsule 10 is inserted into the clamp of the beverage brewing machine, wherein the inner walls of the clamp members in a closed position define a chamber adapted to substantially enclose and support the beverage capsule. In other words, the capsule is substantially completely enclosed by, and in contact with, the inner surfaces of the clamp cavity. This allows the cavity to support the beverage brewing capsule enclosed within the cavity, thereby enabling high hydrostatic pressures to be developed inside the capsule without bursting the capsule. The capsule is preheated by the heater before and during beverage preparation. A hollow needle is inserted through the channel in the top of the clamp and into the nozzle bore of the capsule to pierce the membrane seal, and hot water is injected at a pressure of approximately 10 bar gauge to brew coffee inside the capsule. An O-ring is fitted in a fixed position on the injection tube and held in said position by flanges on the injection tube for sealing against a complementary annular recess in the top of the capsule nozzle. The clamp assembly is adapted to apply a pinch force to the outlet of the capsule so as to achieve an optimum combination of beverage escape rate from the capsule and back pressure to optimize beverage quality and brewing speed. The pinch is applied to the outlet channel of the capsule just sufficient to permit the resulting beverage to escape through the outlet channel at the desired rate while maintaining high pressure inside the capsule, without excessive build-up of back pressure in the ingredient chamber. The pressure and temperature of the hot coffee in the downstream chamber causes the weakly bonded margin region 13 at the bottom of the capsule to peel apart, releasing the resulting coffee in a controlled fashion.

Figure 2:
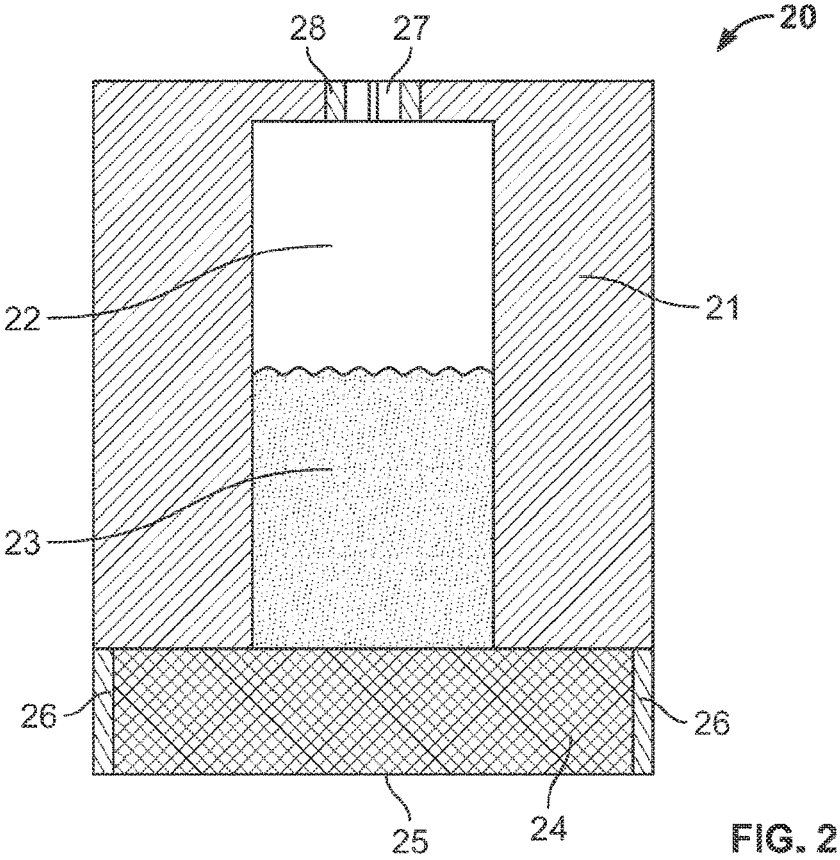
FIG. 2 shows a plan view, partially cut away, of a first beverage preparation capsule according to the present invention.

Referring to FIG. 2, the capsule 20 according to the present invention comprises two flexible laminate sheets. Each laminate sheet comprises an inner thermoplastic sealing film. The front and back sheets are bonded together with a peelable adhesive 21 around the side regions of the capsule, which is approximately 20 mm wide, and forms a central chamber 22 containing a beverage preparation ingredient 23, which may be about 15 g of ground roasted coffee. The peelable adhesive can be released by the action of heat and/or pressure of liquid inside the capsule, and/or assisted by heat applied from outside the capsule. A filtration element 24 is formed by rolling up and flattening a sheet of filter sheet material and is located in an outlet channel 25 at the bottom peripheral edge of the capsule and downstream from the chamber containing the beverage preparation ingredient. The filtration element 24 is bonded to the front and back sheets and secured with two peripheral welds 26, which are permanent seals. An inlet 27 is located in the top peripheral edge of the capsule and is held in place by a permanent weld 28 between the sheets, suitably formed by heat or ultrasonic bonding. The inlet 27 has a central cylindrical bore, which may be sealed with the frangible freshness barrier. The capsule provides an oxygen and moisture-impermeable enclosure for the beverage preparation ingredient until the capsule is used.

Figure 3:
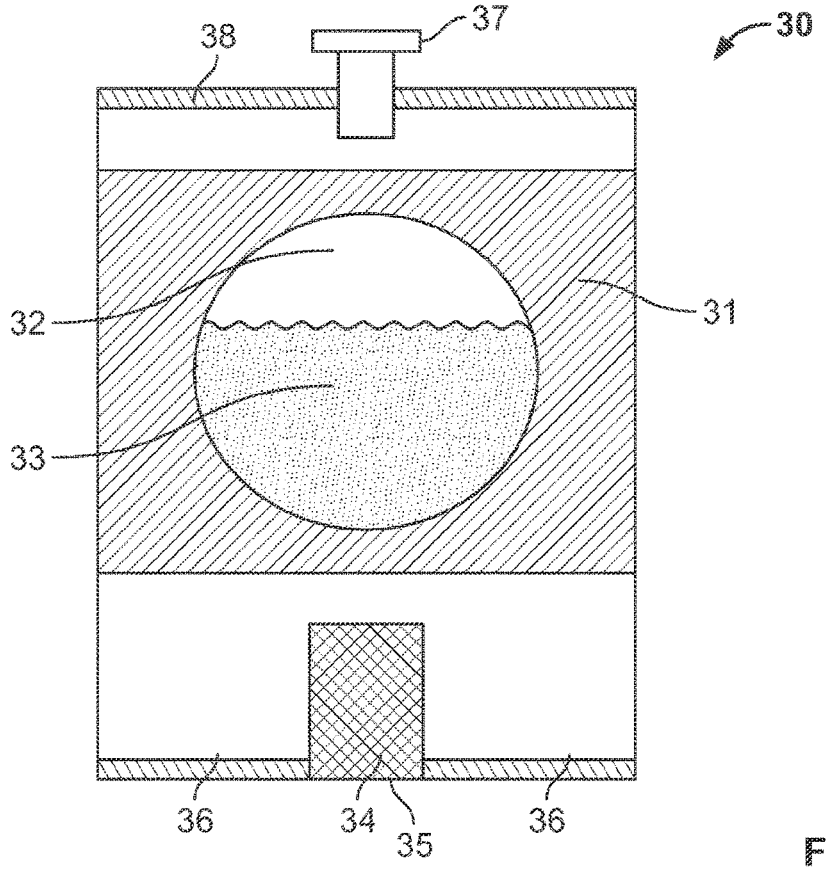
FIG. 3 shows a plan view, partially cut away, of a second beverage preparation capsule according to the present invention.

FIG. 3 shows a further embodiment of the invention, in which the beverage preparation ingredient is kept separated from the inlet nozzle and filter. The capsule 30 comprises two flexible laminate sheets. Each laminate sheet comprises an inner thermoplastic sealing film. The front and back sheets are bonded together with a peelable adhesive 31 around the top, bottom and side regions of the capsule, which forms a central chamber 32 containing a beverage preparation ingredient 33, which may be about 15 g of ground roasted coffee. The peelable adhesive can be released by the action of heat and/or pressure of liquid inside the capsule, and/or assisted by heat applied from outside the capsule. A transverse permanently bonded seam 36 between the front and back sheets extends across the bottom edge of the capsule. An unbonded gap is left in the intermediate seam to provide the outlet channel 35 from the beverage preparation chamber. This gap is filled by a filtration element 34 formed by rolling up and flattening a sheet of filter sheet material. The filtration element 34 is bonded to the front and back sheets in the gap. The filtration element projects into the main body of the capsule so as to increase the area available for filtration and to prevent filter blocking in use. A nozzle 37 is located in the top peripheral edge of the capsule and is held in place by a permanent weld 38 between the sheets, suitably formed by heat or ultrasonic bonding. The nozzle 37 has a central cylindrical bore, which may be sealed with the frangible freshness barrier. The capsule provides an oxygen and moisture-impermeable enclosure for the beverage preparation ingredient until the capsule is used.

Figure 4:
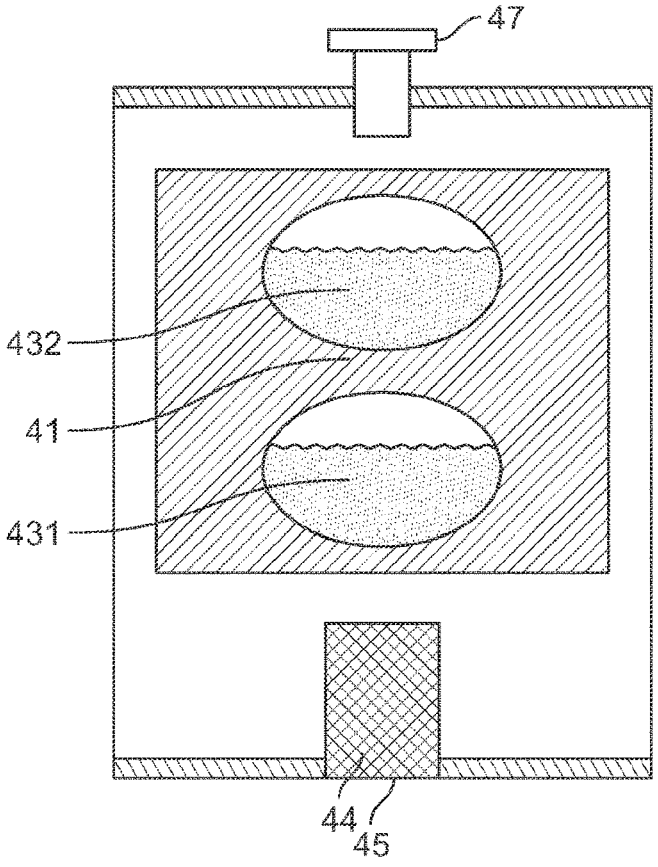
FIG. 4 shows a plan view, partially cut away, of a third beverage preparation capsule according to the present invention.

FIG. 4 shows an embodiment of the invention, which is similar to the capsule of FIG. 3, but contains two different beverage preparation ingredients 431 and 432 which are kept separate by a region of peelable adhesive 41 around the top, bottom and side regions of the capsule, and also between the two beverage preparation ingredients. In use, when liquid is injected into nozzle 47, the region of peelable adhesive peels apart to allow the liquid to reach both beverage preparation ingredients 431 and 432 and mix the ingredients together. The mixed beverage then escapes through the outlet channel 45 and is filtered by filter element 44.

Figure 5:
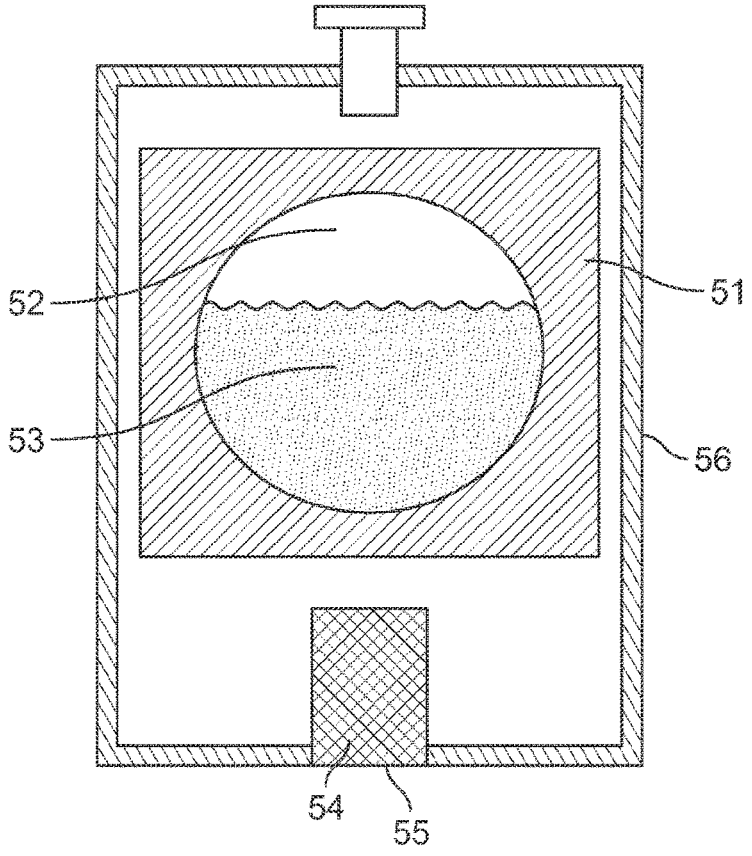
FIG. 5 shows a plan view, partially cut away, of a fourth beverage preparation capsule according to the present invention.

FIG. 5 shows an embodiment of the invention, which is similar to the capsule of FIG. 3, but includes permanent welds around the entire periphery of the capsule. As for FIG. 3, the front and back sheets are bonded together with a peelable adhesive 51 around the top, bottom and side regions of the capsule, which forms a central chamber 52 containing a beverage preparation ingredient 53. However, in addition, a permanent weld 56 is provided around the peripheral edge of the capsule. An unbonded gap is left in the weld 56 to provide the outlet channel 55 from the beverage preparation chamber. This gap is filled by a filtration element 54 formed by rolling up and flattening a sheet of filter sheet material and bonding the filter to the front and back sheets in the gap. This embodiment can also be used in a non-clamping beverage preparation apparatus, because the permanent weld 56 can resist a certain amount of pressure inside the capsule.

Figure 6:
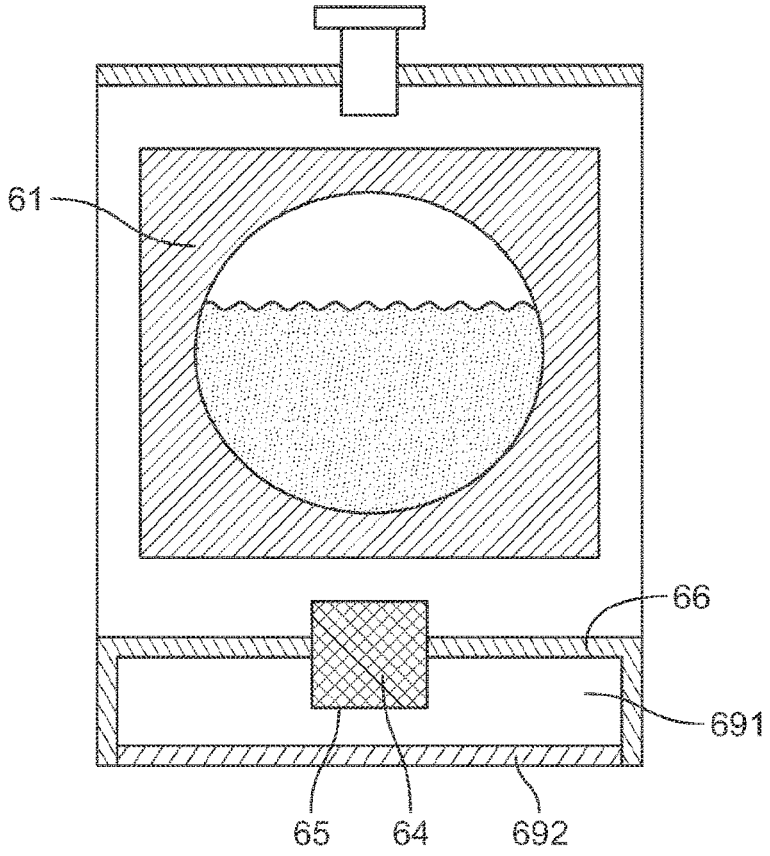
FIG. 6 shows a plan view, partially cut away, of a fifth beverage preparation capsule according to the present invention.

FIG. 6 shows an embodiment of the invention, which is similar to the capsule of FIG. 3, but further comprises a downstream collection/conditioning chamber 691. In this embodiment, a transverse permanently bonded seam 66 between the front and back sheets extends across the capsule intermediate the top and bottom edges to divide the capsule into a beverage ingredient containing region and a downstream beverage collection/conditioning chamber 691. The intermediate seam does not extend completely across the capsule. An unbonded gap is left in the intermediate seam to provide the outlet channel 65 from the beverage preparation chamber. This gap is filled by a filtration element 64 formed by rolling up and flattening a sheet of filter sheet material. The filtration element 64 is bonded to the front and back sheets in the gap. The filtration element projects into the main body of the capsule so as to increase the area available for filtration and to prevent filter blocking in use. A further peelable seal 692 can be provided at the base of the collection/conditioning chamber to seal the collection/conditioning chamber before use and provide improved freshness.

Figure 7:
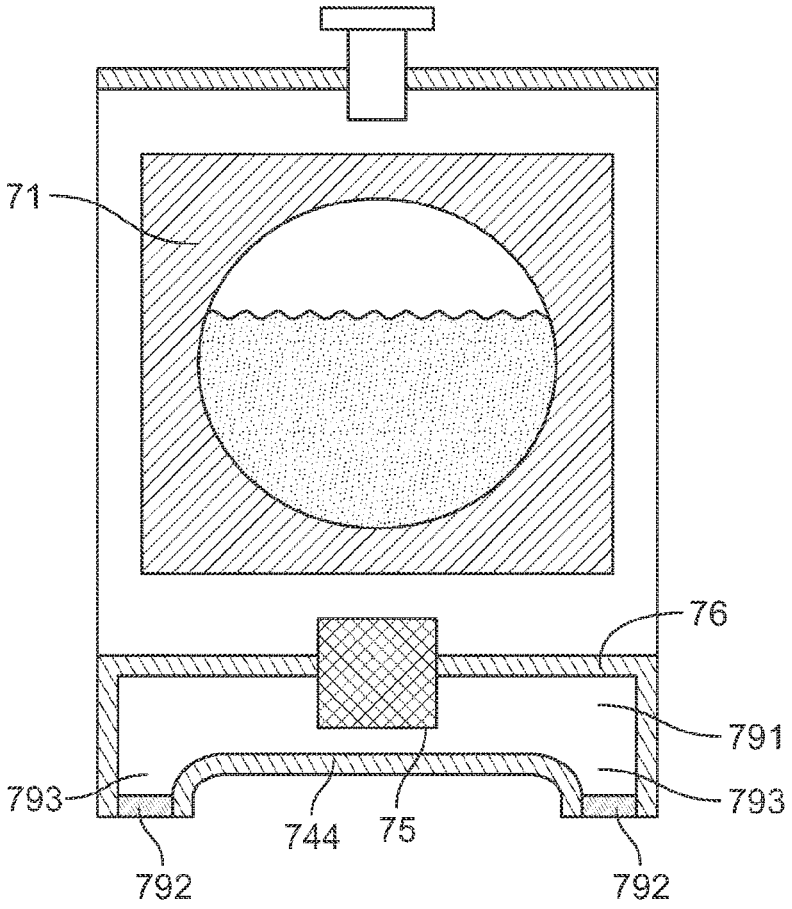
FIG. 7 shows a plan view, partially cut away, of a sixth beverage preparation capsule according to the present invention.

FIG. 7 shows an embodiment of the invention, which is similar to the capsule of FIG. 6, but wherein the downstream collection/conditioning chamber is bifurcated by an arcuate permanent weld 794 located at the base of the collection/conditioning chamber. The bifurcated beverage collecting/conditioning chamber 791 resembles the outlet of a conventional espresso machine. The bifurcated collecting/conditioning chamber 791 has two outlets 793 proximate to opposite edges of the capsule. Each outlet 793 is sealed by releasable/peelable seal 792 in the bottom edge thereof to maintain freshness of the capsule ingredients before use. The bifurcated chamber 791 directs the beverage accurately into a receptacle such as a cup, and furthermore results in a better conditioned foam "crema" on the resulting coffee. That is to say, a crema with a more uniform, small bubble size.

It can readily be seen that the above capsules can be manufactured by making appropriate modifications of the methods used to make the capsules of GB-A-2121762, GB-A-2122881, EP-A-0179641, EP-A-0247841 and WO-A-9905044.

Figure 8:
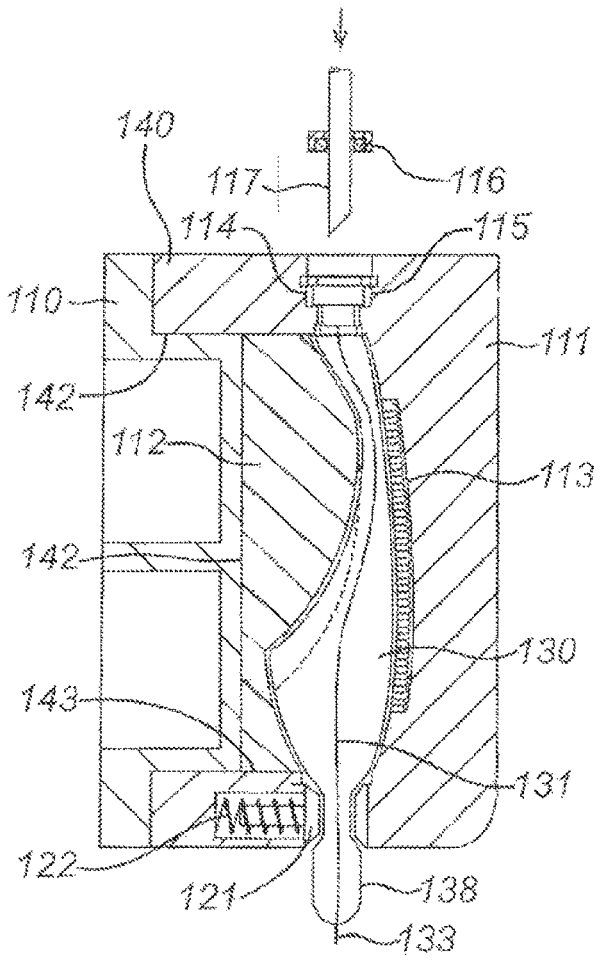
FIG. 8 shows a schematic longitudinal sectional view of a capsule according to the invention being used to prepare a beverage in a clamp assembly.

FIG. 8 shows a schematic section of a clamp assembly which can be used with the beverage preparation capsules of the present invention. The clamp comprises left and right clamp shells 110,111. The right clamp shell 111 is formed of metal or a hard plastic such as polytetrafluorethylene. The left clamp shell 110 has a frame 140 of metal or a hard plastic such as polytetrafluorethylene. A sheet 112 of resilient elastomer is bonded to the frame around its periphery 143. The sheet 112 is supported by a solid piston face 142 that is movable laterally to press the elastomer sheet 112 forward to a first position where it approaches the capsule 130. The right clamp shell 111 has an electrical heating element 113 embedded therein for pre-heating of the capsule contents. The inner surfaces of the shells 110,111 are concave to receive the capsule during beverage preparation. In this embodiment the shells are mounted in parallel and moved directly into abutment by suitable mechanical clamping means such as a vice, lever arm or the like (not shown). The peelable adhesive regions 21, 31, 41, 51, 61, 71 around the side regions of the capsule are gripped by the edges of the clamp shells, but without gripping beverage ingredient located in the central chamber of the capsule.

In combination with certain embodiments of capsule, such shown in FIG. 6 or 7, the bottom of the clamp shells 110,111 is positioned to pinch the intermediate transverse seal 66, 76 and outlet channel 65, 75 of the capsule. The downstream chamber 691, 791 of the capsule is therefore positioned outside the clamp during the beverage preparation step. The bottom of the clamp shells has elements for applying a controlled pinch force to the outlet channel of the capsule. The bottom face of the first clamp shell comprises an opening and a piston 121 seated in the opening and capable of reciprocal motion relative to the inside surface of the clamp shell. The piston is spring loaded so as to apply a biasing force to the piston to press the front face of the piston against the capsule in the region of the outlet channel with a fixed (but adjustable) force. The bottom face of the second clamp shell 111 comprises a shallow recess suitably about 0.5-4 mm deep situated in the centre of the pinch zone opposite the outlet channel of the capsule.

In use, the capsule is inserted into the clamp of the beverage brewing machine, where it is gripped by the clamp around the peelable side regions of the capsule, but without gripping beverage ingredient located in the central chamber of the capsule. The capsule is preheated by the heater 113 before and during beverage preparation. A hollow needle 117 is inserted through the channel in the top of the clamp and into the nozzle bore of the capsule to pierce the membrane seal, and hot water is injected at a pressure of approximately 10 bar gauge to brew coffee inside the capsule. The bonded regions of the capsule comprising a peelable seal peel apart upon injection of the water such that the chamber of the capsule containing the beverage preparation ingredient expands to fill the enclosed space of the clamp assembly. An O-ring 116 is fitted in a fixed position on the injection tube and held in said position by flanges on the injection tube for sealing against a complementary annular recess in the top of the capsule nozzle 114. The pinch applied to the outlet channel of the capsule is just sufficient to permit the resulting beverage to escape through the outlet channel at the desired rate while maintaining high pressure inside the capsule, without excessive build-up of back pressure in the ingredient chamber. The pressure and temperature of the hot coffee in the downstream chamber causes the weakly bonded margin region 133 (if present) at the bottom of the capsule to peel apart, releasing the resulting coffee in a controlled fashion.

Figure 9:
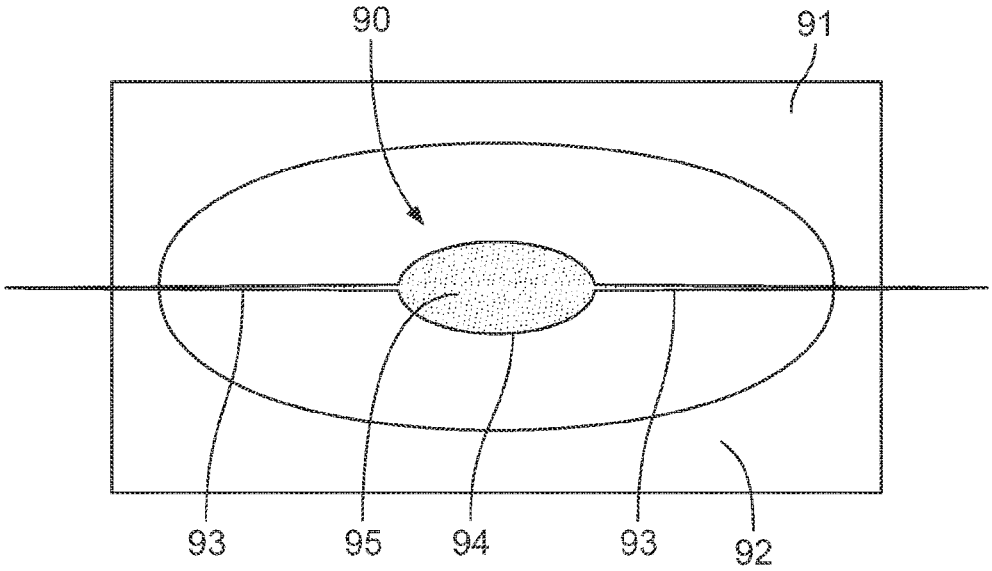
FIG. 9 shows a schematic lateral sectional view of a capsule of the present invention in a clamp assembly before injection of liquid into the capsule.
Figure 10:
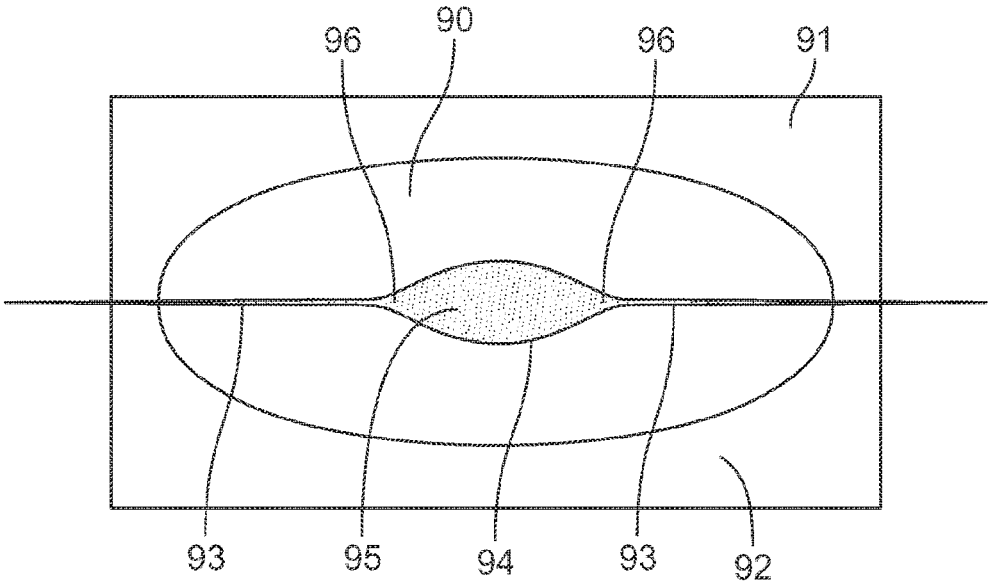
FIG. 10 shows a schematic lateral sectional view of FIG. 9 as liquid is being injected into the capsule.
Figure 11:
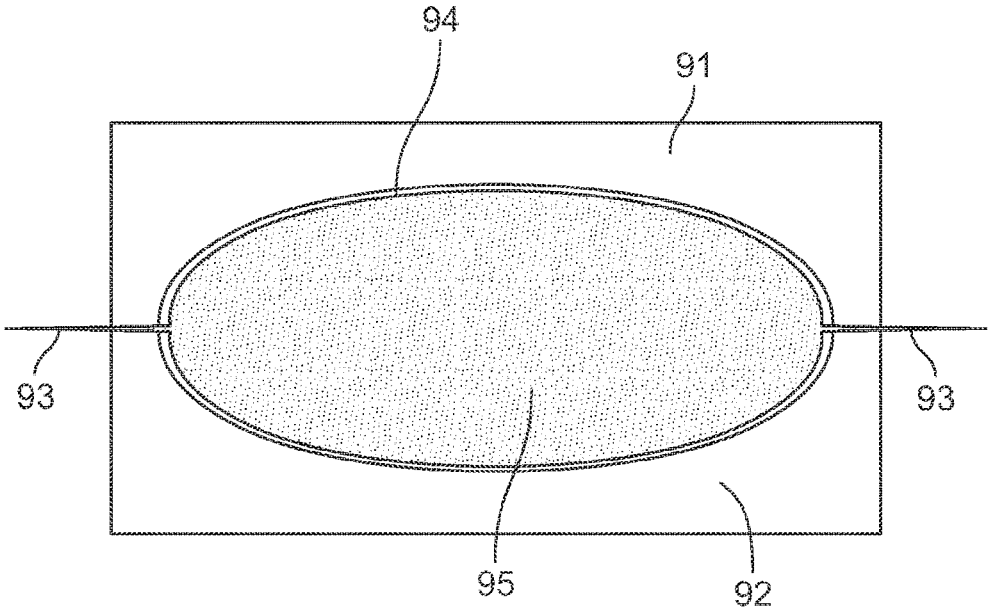
FIG. 11 shows a schematic lateral sectional view of FIGS. 9 and 11 after completion of the injection of liquid into the capsule.

FIGS. 9, 10 and 11 are a sequence of representations showing a lateral sectional view of a capsule of the present invention during use.

In FIG. 9, the capsule 90 is inserted into the clamp assembly of the beverage brewing machine, where it is gripped by the clamp members 91 and 92 with sufficient force to resist the pressure of fluid injected into the capsule. The clamp members are mounted in parallel and moved directly into abutment by suitable mechanical clamping means such as a vice, lever arm or the like (not shown).

However, when the clamp members are closed, they close upon the peelable bonded regions 93 of the capsule around the side regions of the central chamber 94 of the capsule containing the beverage preparation ingredient 95. Importantly, the clamp members 91, 92 do not clamp over the central chamber 94 containing the beverage preparation ingredient 95.

In FIG. 10, a hollow needle is inserted through the inlet region in the top of the clamp assembly and into the nozzle bore of the capsule (not shown) to pierce the membrane seal, and hot water is injected at a pressure of approximately 10 bar gauge to brew the beverage preparation ingredient 95 inside the capsule. The pressure and temperature of the hot coffee in the downstream chamber causes the peelable bonded regions 93 to peel apart at the edges 96 of the central chamber 94 of the capsule. The central chamber 94 therefore begins to expand as the water continues to be injected into the capsule.

Suitably, the water may be injected at a pressure of from about 5 to about 15 bar gauge, for example about 10 bar gauge. Typically, the aqueous fluid is injected at a temperature of from about 88° C. to about 98° C., for example about 90° C. The liquid may be injected into the capsule at an average rate suitably from about 25 ml/min to about 500 ml/min and more preferably from about 50 to about 150 ml/min. The duration of the water injection is suitably from about 10 to about 30 seconds, for example about 12 to about 15 seconds. This enables espresso-type coffee to be produced. The liquid may be injected in intermittent or pulsed fashion to optimise the organoleptic properties of the product.

In FIG. 11, the expansion of the central chamber is complete, and the central chamber 95 containing the beverage preparation ingredient 94 now fills the available space of the cavity formed by the clamp members 91 and 92. As discussed above, the clamp members 91 and 92 grip the capsule with sufficient force to resist the pressure of fluid injected into the capsule, so the central chamber 95 of the capsule cannot expand any further. Peripheral regions of peelable bonding 93 will be left between the clamp members 91 and 92 and potentially outside of the clamp.

After the step of FIG. 11, the method may further comprise a step of injecting air into the capsule after brewing to expel residual beverage from the capsule. Alternatively or additionally, dewatering of the residue may be achieved by compressing the ingredient bed after brewing by moving one or both movable clamp walls inwardly, potentially by means of additional clamping means or an expandable member.

Suitably, substantially all steps of the method other than the selection of beverage type and insertion of the capsule into the clamp are performed automatically by the apparatus.

Figure 12:
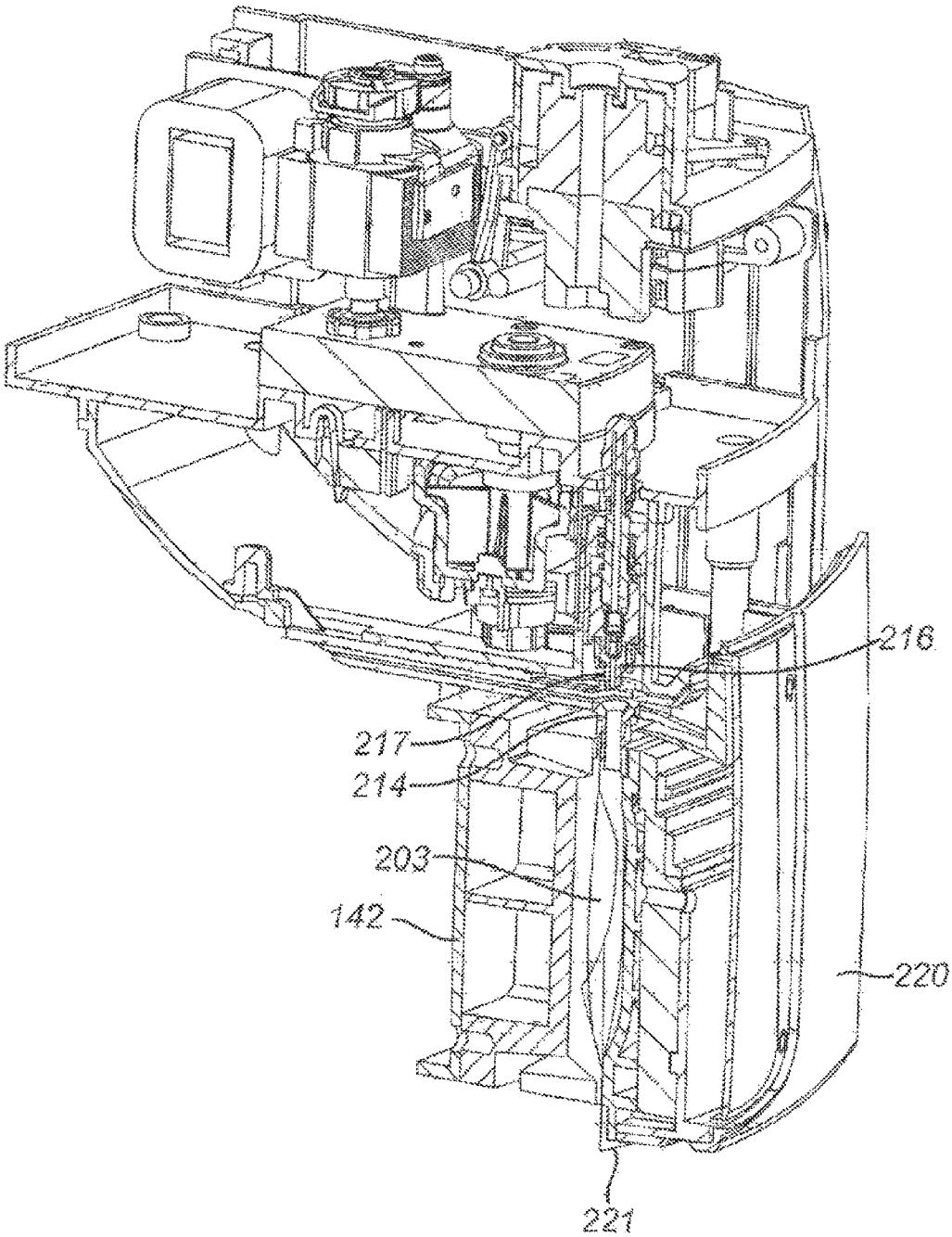
FIG. 12 shows a general cut-away view of a beverage preparation machine.

FIG. 12 shows a general view, partially cut-away, of a beverage making apparatus suitable for use with the capsules of the present invention. Visible are the cavity for receiving the beverage capsule. The front clamp shell is hinged at the bottom 221 so that door 220 can pivot outwardly for insertion of a capsule into the capsule cavity. Injector 117 is mounted on a suitable drive mechanism for automatic retraction and insertion into the capsule. O-ring 116 is mounted on a flange on the injector so that it forms a seal against a countersunk top rim 214 of the nozzle holder of the clamp (i.e. in this embodiment the O-ring seals against the top of the clamp, not against the top of the capsule nozzle itself).

The apparatus comprises a pump for supplying water to the injector tube at pressures greater than about 5 bar gauge, for example at about 10-15 bar gauge. A typical pump is a shuttle pump that operates at fixed displacement and fixed speed, whereby the water flow rate decreases as the back pressure increases up to a maximum pressure of typically about 16 bar. Suitably, the apparatus further comprises a heater to supply an aqueous brewing medium such as hot water or steam, suitably hot water at a temperature of suitably about 80 to about 100° C. to the pump.

The apparatus may comprise a pressure sensor to measure the pressure in the liquid inlet line to the capsule in the clamp (the back pressure). In embodiments, the apparatus may further comprise control elements to vary the pump output and/or the configuration of the outlet channel region of the clamp in response to the measured back pressure, for example to maintain a substantially constant back pressure during beverage preparation.

The apparatus may comprise a capsule recognition device in the clamp assembly operatively associated with the control system and the display of the apparatus. At its simplest, this device may be a simple bimodal detector, such as a source of UV light and a light detector, for detecting whether a fluorescent region is present on a capsule. More complex capsule recognition devices such as bar code readers or RFID chip detectors are also contemplated. The primary purpose of the capsule recognition device is to determine whether the right type of capsule has been inserted into the clamp, i.e. a high-pressure capsule of the kind described in accordance with the present invention for a high pressure brewing clamp. If the recognition device determines that the wrong type of capsule has been inserted, then the control system is programmed to prompt the user to change the capsule. In embodiments, the recognition device may read further information from the capsule relating to the capsule ingredients and the control system then adapts the brew cycle parameters such time/temperature/water volume to optimize the product for that ingredient.

The above embodiments have been described by way of example only. Many other embodiments falling within the scope of the accompanying claims will be apparent to the skilled reader. For example, it will be appreciated that, for economy of the description, the preferred and alternative features have in some cases been described in relation to only one aspect of the invention even though they are applicable to all of the other aspects. Accordingly, any feature that has been described above in relation to any one aspect of the invention may also be applied to any other aspect of the invention.

The invention claimed is:

1. A beverage preparation capsule containing a beverage preparation ingredient, the beverage preparation capsule comprising front and back sheets of substantially air-and liquid-impermeable flexible film material bonded together in face-to-face relationship along a top region, first and second side regions, and a bottom region to define a chamber containing the beverage preparation ingredient, wherein said bottom region comprises an outlet channel for escape of beverage from the chamber containing the beverage preparation ingredient, wherein at least a region of said outlet channel is filled by a filtration material for filtering said beverage escaping from the chamber, and wherein at least one bond between said front and back sheets of flexible film material comprises a peelable seal that defines a first side boundary of the chamber and a second side boundary of the chamber, and wherein upon a liquid being injected into the chamber, the peelable seal is configured to peel apart to expand the chamber.

2. The beverage preparation capsule of claim 1, further comprising a permanent seal between said front and back sheets along a peripheral edge of said beverage preparation capsule, said peelable seal being positioned inward of said permanent seal.

3. The beverage preparation capsule of claim 1, wherein said peelable seal extends about 10 mm to about 30 mm in from a peripheral edge of the capsule.

4. The beverage preparation capsule of claim 1, wherein said peelable seal further defines a top boundary of the chamber and a bottom boundary of the chamber so that said peelable seal encircles the chamber containing the beverage preparation ingredient.

5. The beverage preparation capsule of claim 1, wherein the peelable seal comprises a central section that divides the chamber into an upper chamber and a lower chamber, wherein the beverage preparation ingredient comprises a first beverage preparation ingredient located in the upper chamber and a second beverage preparation ingredient located within the lower chamber, and wherein said peelable seal completely encircles both of said upper and lower chambers.

6. The beverage preparation capsule of claim 1, wherein the peelable seal has a peak load seal strength of about 6 N for a 25 mm width sample.

7. The beverage preparation capsule of claim 1, further comprising a permanent transverse seal between said front and back sheets of flexible film material, wherein said permanent transverse seal extends laterally across said capsule between opposed side edges and below a top edge of the capsule, and wherein said permanent transverse seal has a gap defining the outlet channel.

8. The beverage preparation capsule of claim 1, further comprising a permanent peripheral seal between said front and back sheets of flexible film material around all peripheral edges of the capsule with the exception of the outlet channel, the permanent peripheral seal defining an interior of the beverage preparation capsule having a first volume, wherein said peelable seal is located in the interior of the capsule within a periphery defined by the permanent peripheral seal, the peelable seal surrounding the chamber so that the chamber has a second volume that is less than the first volume.

9. The beverage preparation capsule according to claim 1, wherein said filtration material is in the form of a plug of filtration material located in said outlet channel.

10. A beverage preparation capsule according to claim 1, wherein said filtration material projects from the outlet channel into the chamber containing the beverage preparation ingredient or projects from the outlet channel into a bonded region comprising a second peelable seal located downstream from the chamber containing the beverage preparation ingredient.

11. A beverage preparation capsule according to claim 1, wherein said capsule further comprises an outlet chamber in fluid communication with a downstream end of said outlet channel, said outlet chamber having one or more outlets for escape of beverage from the capsule.

12. A beverage preparation capsule according to claim 11, wherein said outlets are sealed by a heat-releasable adhesive prior to use of the capsule.

13. A beverage preparation capsule according to claim 1, further comprising an inlet nozzle in fluid communication with said chamber containing the beverage preparation ingredient for injection of water into the chamber, or in fluid communication with a bonded region comprising a peelable seal located upstream of said chamber containing the beverage preparation ingredient for injection of water into the chamber.

14. A method of making a beverage comprising:

inserting a beverage preparation capsule according to claim 1 into a clamp assembly of a beverage preparation apparatus, the clamp assembly comprising two or more clamp members, at least one clamp member being movable to open and close the clamp assembly, wherein respective inner walls of said clamp members in a closed position define an enclosed space adapted to receive the beverage preparation capsule, the enclosed space having an inlet region for injection of water and an outlet region for escape of a beverage, the enclosed space of the clamp assembly being larger than the chamber of the capsule containing the beverage preparation ingredient before use;

injecting an aqueous liquid into said capsule at a pressure greater than about 1 bar gauge to produce a beverage in said capsule, wherein the peelable seal of the capsule peels apart upon injection of the aqueous liquid such that the chamber of the capsule containing the beverage preparation ingredient expands to fill the enclosed space of the clamp assembly; and allowing said beverage to escape through the outlet region.

15. The beverage preparation capsule of claim 1 further comprising a longitudinal axis, wherein the first and second side boundaries of the chamber are located on opposite sides of the longitudinal axis.

16. The beverage preparation capsule of claim 15 wherein the peelable seal defining the first and second side boundaries of the chamber extends along an entirety of a length of the chamber in a direction of the longitudinal axis.

17. The beverage preparation capsule of claim 1 wherein the capsule comprises a peripheral edge comprising a top edge, a bottom edge, a first side edge, and a second side edge, and wherein the peelable seal extends from the chamber to the first and second side edges of the peripheral edge of the capsule.

18. The beverage preparation capsule of claim 1 further comprising a permanent seal located along a periphery of the capsule, wherein the peelable seal entirely surrounds the chamber, the peelable seal terminating at an outer edge that is spaced inwardly relative to the permanent seal such that no part of the peelable seal contacts the permanent seal.

19. The beverage preparation capsule of claim 1 further comprising a bottom edge, a top edge, a first side edge, and a second side edge, the peelable seal extending vertically alongside the chamber in a direction between the bottom and top edges of the beverage preparation capsule to define the first and second side boundaries of the chamber, and wherein upon the liquid being injected into the chamber, the peelable seal is configured to peel apart to expand the chamber in a direction towards the first and second side edges of the beverage preparation capsule.

20. A beverage preparation capsule containing a beverage preparation ingredient, the beverage preparation capsule comprising front and back sheets of flexible film material that are bonded together by a permanent weld along a periphery of the beverage preparation capsule, a gap in the permanent weld forming an outlet channel, and wherein the front and back sheets of flexible film material are bonded together with a peelable adhesive that is positioned inward of the permanent weld, the peelable adhesive surrounding a central chamber that is filled with the beverage preparation ingredient, wherein upon a liquid being injected into the chamber, the peelable seal is configured to peel apart to expand the chamber, the liquid flowing through the beverage ingredient in the chamber and exiting the beverage preparation capsule through the outlet channel.

* * * * *